United States Patent [19]

Swain

[11] 3,994,526

[45] Nov. 30, 1976

[54] COMBINATION CHAIR AND LOOM

[76] Inventor: Jeanne M. Swain, 801 S. 25th St., Allentown, Pa. 18103

[22] Filed: Oct. 14, 1975

[21] Appl. No.: 621,644

[52] U.S. Cl. ..... 297/118
[51] Int. Cl.[2] ..... A47C 13/00
[58] Field of Search ..... 297/217, 463, 118, 441, 297/129, 442; 139/29, 11

[56] References Cited

UNITED STATES PATENTS

| | | | |
|---|---|---|---|
| 521,395 | 6/1894 | Van Norman | 297/442 |
| 604,212 | 5/1898 | Palmer | 297/441 |
| 655,593 | 8/1900 | Webb | 297/129 |
| 658,842 | 10/1900 | Harris | 297/217 X |
| 2,119,387 | 5/1938 | Harvey | 297/441 X |
| 2,640,505 | 6/1953 | Klaesson | 139/29 |
| 3,885,597 | 5/1975 | Hines | 139/29 |

FOREIGN PATENTS OR APPLICATIONS

| | | | |
|---|---|---|---|
| 1,382,834 | 2/1975 | United Kingdom | 297/284 |

*Primary Examiner*—James T. McCall
*Attorney, Agent, or Firm*—James C. Simmons

[57] ABSTRACT

A multi-purpose chair having generally parallel L-shaped sides spaced apart and held by a plurality of elongated members. The base of said L-shaped portion of each side contains a slotted aperture, each slot supporting portions of a slidable bar in said aperture. One of said elongate members is disposed adjacent said slotted apertures to support a plurality of heddles. The chair is constructed so that when a plurality of warp threads are wound around said supports through said heddles and over said bar, the chair is converted to an Inkle-type loom with a shedding bar. Accessories include a shuttle and a woven cover which is supported by the elongate members to form the chair seat.

3 Claims, 3 Drawing Figures

3
22
20
54
26
14
12
40
18
24
16
3
46
28
22
30
20
32
44
38
42
33
34
26
14
40
12
24
40
36
35
18
10
16

50
52
28
56
54
30
32
42
44
38
40
14
33
26
58
34
18
36
35

COMBINATION CHAIR AND LOOM

BACKGROUND OF THE INVENTION

1. Field of the Invention

This invention pertains to furniture and, in particular, to a multi-purpose chair which can be used as a loom. The chair portion is of the type that comprises a rigid frame with a flexible seat, usually of a piece of elongated woven cloth supported at the ends by members on the frame. The loom portion of the chair is the result of the placement of a plurality of support members to hold the yarn (warp) to be woven in the manner of the well-known Inkle loom.

2. Description of the Prior Art

The Inkle loom has been known for many years; however, such looms require the operator (weaver) to use one hand to operate the shuttle carrying the shuttle yarn or woof or weft threads, and the other hand to change the sheds which are made up of groups of warp threads or individual strands of yarn alternately raised and lowered after each pass of the shuttle yarn. The general side view configuration of an Inkle loom is similar to FIG. 3 of U.S. Pat. No. 1,007,897. U.S. Pat. Nos. 737,073; 758,376; and 760,919 are examples of simple hand looms without moveable sheds. Examples of hand looms with moveable sheds are amply illustrated by U.S. Pat. Nos. 1,274,948; 1,615,805; 2,253,167; 2,077,532; and 2,797,710. U.S. Pat. Nos. 2,817,366 and 3,776,280 disclose methods for changing sheds on a weaving machine.

In all of the prior art devices, the sheds in hand looms had to be raised or lowered by hand (Inkle) or by complicated mechanical arrangements (patents cited above) and in either case, the loom had no other purpose save weaving.

SUMMARY OF THE INVENTION

In order to overcome the problems of prior art hand looms, I have discovered a device that enables rapid changing of the sheds by means of a shedding bar. This is achieved by providing generally L-shaped sides for the loom where the base of the L-shaped section of each side contains an inclined, slotted aperture, one side being the mirror image of the other, with a plurality of elongate supports disposed between the sides in an open lattice-type arrangement and the slotted apertures support a generally flat bar between them for movement along the slot. The supports are constructed and arranged so that a plurality of heddles can be supported above the shedding bar and the warp yarn or threads are wound around the supports through the heddles and alternately over and under the bar so that shedding is accomplished by moving the bar from one end of the slotted aperture to the other. Accessories include the shuttle and an elongated woven cover which can be supported by the supports to form a chair similar to the old-type wooden frame and canvas camping chairs.

Therefore, it is the primary object of this invention to provide an improved chair.

It is another object of this invention to provide a combination chair and hand loom.

It is yet another object of this invention to provide a simple apparatus for changing sheds on a hand loom.

DETAILED DESCRIPTION OF THE PREFERRED EMBODIMENT

Figures 1, 2, 3:
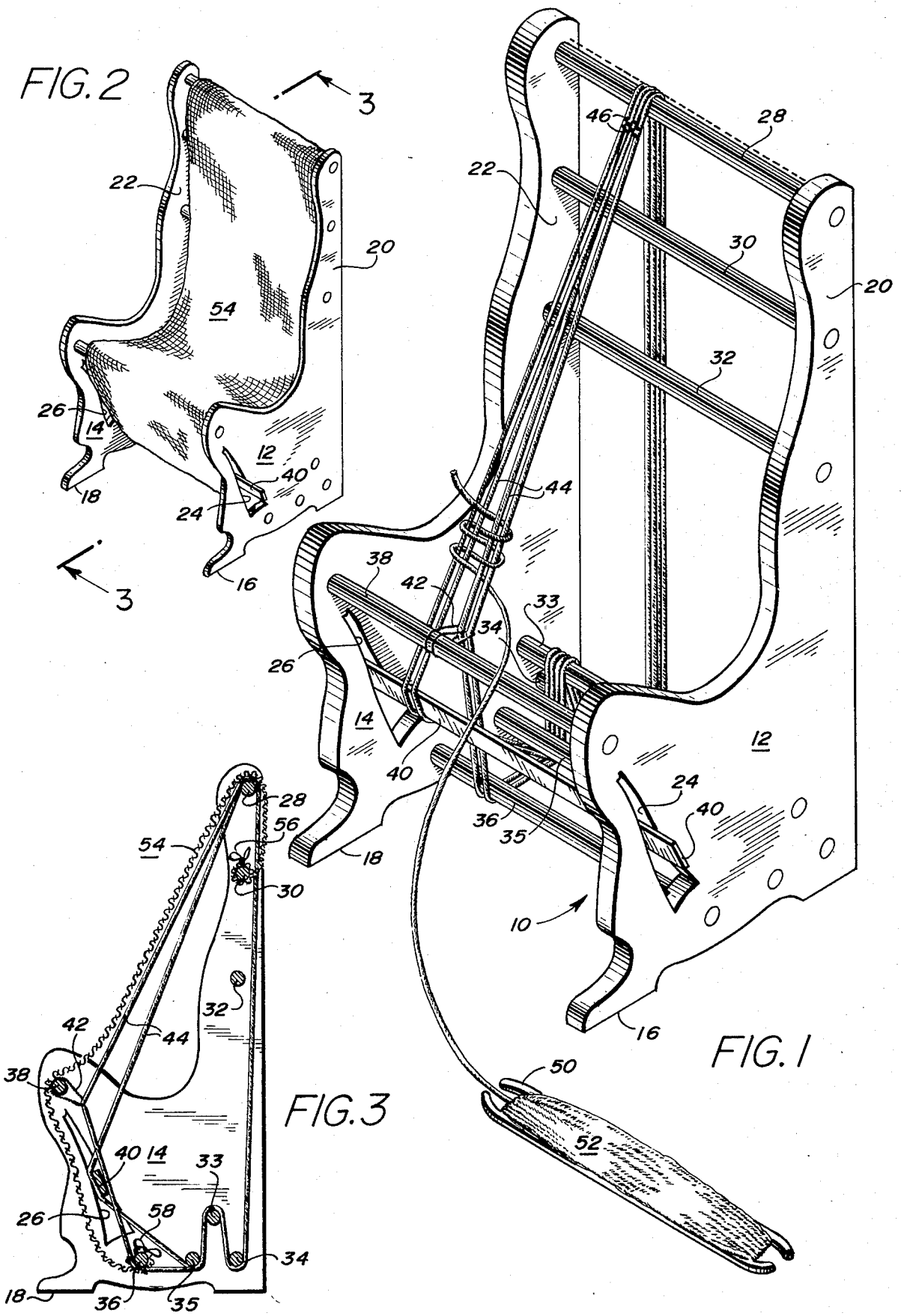
FIG. 1 is an isometric drawing of the chair of the instant invention set up for weaving.
FIG. 2 is a reduced isometric drawing of the device of FIG. 1 with the chair covering in place.
FIG. 3 is a view taken along lines 3—3 of FIG. 2.

Referring to the drawing, there is shown in FIG. 1 a chair-like structure 10 having a first generally L-shaped planar side 14. Sides 12 and 14 have base or seat portions 16, 18 respectively corresponding to the base of the L and upright or seat back portions 20, 22 corresponding to the vertical bar of the L. The base portions 16, 18 of sides 12, 14 include angled slots 24, 26 respectively, the purpose of which will be explained subsequently.

Disposed between sides 12, 14 are a plurality of elongate supports 28, 30, 32, 33, 34, 35, 36, and 38. The supports are preferably of cylindrical shape and are securely fastened between sides 12 and 14.

A shedding bar 40 of generally flat elongated rigid material is disposed in slots 24, 26 between sides 12, 14 for movement along the slots 24, 26. Above shedding bar 40, a plurality of heddles 42 are fastened to support 38. The heddles 42 can be of any construction known in the art, however, ordinary household string or twine is quite adequate for a device as shown.

A plurality of warp threads or yarn 44 are disposed around supports 28, 34, 33, 35, 36, and 38 as shown in FIGS. 1 and 3. Half of the warp thread, forming a first shed, pass above shedding bar 40 and through heddles 42 while the balance of the warp threads or yarn 44, forming a second shed, pass under the shedding bar 40 and bypass heddles 42 as shown in FIG. 3. Warp threads 44 are fastened at their respective ends at 46 by a knot, clamp, or other fastener.

Shuttle 50 is included in order to provide a source of shuttle yarn 52.

In operation, warp threads 44 are placed as shown and with a width sufficient for the desired weaving such as a tie, belt, placemat, or the like. The shuttle 50 is passed through the space between the warp threads 44 held by heddles 42 and those not supported by heddles 42. After a single pass of the shuttle 50, the shedding bar is moved to a position more remote from its location from the previous shuttle pass.

It will be obvious that the device of FIG. 1 can be placed in any position convenient to the operator to perform operation. The operator can place the back portion of the L-shaped device on the lap and weave in this manner. As the weaving progresses, the entire quantity of warp threads 44 can be moved out of position by the hand by pushing them upwardly toward support 28 and around the loom. After the weaving operation is completed, a simple cut across the warp threads adjacent support 36 will release the woven article from the loom.

It is obvious that the width of the loom can be adjusted by adjusting the length of the support members 28, 30, 32, 34, 35, 36, and 38 as well as bar 40.

FIG. 1 shows a woven cover 54 which is placed on the loom as is illustrated in cross-section in FIG. 3. The cover is fastened at one end to support 30 as by string 56 and at the other end to support 36 by string 58. In this manner, the cover 54 fits loosely over the frame and is allowed to drape as shown in FIG. 2 to form a seat. Support 38 provides the front portion of the seat. As shown, in FIG. 3, there is no need to remove warp threads placed upon the loom in order to convert the loom to a chair.

While the supports are shown as penetrating through the sides 12 and 14 respectively, this need not be the case as the supports can be fastened to the respective sides in any convenient manner.

The key to the invention is the providing of the slotted aperture angled so that the bar can be moved along the path defined by the slot to change the sheds during the weaving operation. The slotted apertures are also placed so that they will not interfere with the use of the chair and the shedding bar need not be removed from the loom when it is being sued as an article of furniture.

Having thus described my invention, what I desire to be secured by Letters Patent of the United States is defined in the following claims.

I claim:

1. A chair comprising in combination:

a first generally L-shaped side, said L-shaped side having a horizontally disposed base portion and a vertically disposed back portion;

an elongated slotted aperture in said base portion, said aperture beginning at a point near the top of said base portion remote from said vertical portion and extending to a point near the bottom of said base portion, said terminating point less remote from said vertical portion than said beginning point;

a second side spaced apart from and parallel to said first side, said second side being a mirror image of said first side;

a plurality of elongate support members disposed between said sides, said members and said sides combining to form a chair frame; and a removable seat disposed between said sides and supported by said elongate members;

a plurality of heddles affixed to an elongate support member disposed adjacent to and above said slotted apertures; and a generally flat elongated bar disposed between and held in slidable contact by said slotted apertures in said first and second sides; whereby, when said seat is removed and a plurality of strands of elongate fiber are disposed around said supports, through said heddles, and alternately over and under said bar, said chair becomes a hand loom, said bar being an operative shedding bar to move the warp thread during weaving.

2. A chair according to claim 1 wherein said seat comprises an elongated woven fabric.

3. A chair according to claim 1 wherein said support members are cylindrical dowels.

* * * * *